United States Patent [19]

Geyer et al.

[11] Patent Number: 4,813,391

[45] Date of Patent: Mar. 21, 1989

[54] ARRANGEMENT FOR INJECTING FUEL FOR A TWO-STROKE ENGINE

[75] Inventors: Werner Geyer, Waiblingen; Roland Schierling, Affalterbach; Hans Nickel, Cottenweiler, all of Fed. Rep. of Germany

[73] Assignee: Andreas Stihl, Waiblingen, Fed. Rep. of Germany

[21] Appl. No.: 231,904

[22] Filed: Aug. 15, 1999

[30] Foreign Application Priority Data

Aug. 15, 1987 [DE] Fed. Rep. of Germany ..... 3727266

[51] Int. Cl.[4] ..... F04B 43/06; F02M 37/04; F02M 59/20

[52] U.S. Cl. ..... 123/73 C; 123/73 AD; 123/500; 417/395

[58] Field of Search ..... 123/73 R, 73 A, 73 AD, 123/73 B, 73 C, 73 CB, 500, 501; 417/380, 46, 395

[56] References Cited

U.S. PATENT DOCUMENTS

| | | | |
|---|---|---|---|
| 2,935,057 | 5/1960 | Perlewitz | 123/73 AD |
| 3,913,551 | 10/1975 | Shaver | 123/73 AD |
| 4,381,741 | 5/1983 | Walsworth | 123/73 AD |
| 4,473,340 | 9/1984 | Walsworth | 123/73 AD |
| 4,551,076 | 11/1985 | BuBois | 123/73 AD |
| 4,627,390 | 12/1986 | Antoine | 123/73 CB |

*Primary Examiner*—David A. Okonsky
*Attorney, Agent, or Firm*—Walter Ottesen

[57] ABSTRACT

The invention relates to a fuel injection arrangement wherein the pump piston of the fuel pump is driven by the pressure in the crankcase of the engine. The fuel injection arrangement includes an opening for tapping the crankcase pressure for actuating a diaphragm in the fuel pump. This opening is controlled by a moving part of the engine such as a crank web or the piston. The moving part closes the opening at least for a portion of the time during which injection occurs thereby delaying the onset of injection to permit a complete combustion during the previous combustion cycle.

11 Claims, 5 Drawing Sheets

ARRANGEMENT FOR INJECTING FUEL FOR A TWO-STROKE ENGINE

FIELD OF THE INVENTION

The invention is directed to a fuel-injection arrangement for a two-cycle engine, especially for portable handheld tools such as motor-driven saws and the like. The fuel injection arrangement includes a fuel injection pump and an injection nozzle opening into the combustion chamber of the two-stroke engine with the injection pump being driven by a pressure-controlled membrane which moves the pump piston. The membrane partitions a work chamber of the injection pump into a pulse chamber and a return chamber. The pulse chamber is connected with the crankcase of the engine via an opening so that the pulse chamber can be charged with the pressure present in the crankcase.

BACKGROUND OF THE INVENTION

A fuel injection arrangement of the kind described above is disclosed in U.S. Pat. No. 4,700,668. The pulse chamber is charged directly with the pressure present in the crankcase whereas the return chamber communicates with the atmosphere. The pump piston is moved up and down in correspondence to changes in pressure in the crankcase and fuel is thereby injected into the combustion chamber of the two-stroke engine.

The pressure in the crankcase is dependent upon the rotational speed and the load of the two-stroke engine. An overpressure develops in the crankcase with a downward movement of the piston in the direction toward bottom dead center whereas the pressure in the crankcase drops to an underpressure with the following upward movement of the piston toward top dead center. In this way, the crankcase pressure changes between positive and negative values with the positive values likewise increasing to a maximum with increasing rotational speed which then remain constant up to the highest speed. The pressure changes lie, for example, approximately between 0.75 bar and −0.2 bar.

If the crankcase pressure is also present directly in the pulse chamber of the injection pump, then the injection operation will begin already when the pressure value "zero" is crossed over. Pressure is built up in the crankcase starting approximately at 60° after top dead center. This leads to the situation that fuel injection begins already when there is still an ongoing combustion from the previous cycle. Furthermore, the injection begins already before the overflow channels are open so that fuel is received almost in the same manner as with the carburetor. However, the purpose of the injection is to first admit fresh air from the overflow channels and then perform the injection.

In order to determine the time of injection in advance, U.S. Pat. No. 4,700,668 suggests providing a control or pilot valve between the pulse chamber and crankcase which clears the pressure-transmitting connection between the crankcase and pulse chamber only after a threshold pressure is exceeded.

A control valve of this kind is, however, complex in its configuration and duration and requires a precise matching and regular maintenance in order to prevent a drift of the response threshold. The point of time of fuel injection is also not precisely determined because of the changes of the pressure in the crankcase with speed.

SUMMARY OF THE INVENTION

It is an object of the invention to provide a fuel injection arrangement having a fuel injection pump actuated by the crankcase pressure of the two-stroke engine which is so configured that a robust and maintenance-free precise control of the time point of injection is made possible without complex additional components.

The invention provides an arrangement for injecting fuel in a two-stroke engine for handheld portable tools such as motor-driven chain saws. The engine has a piston and a cylinder conjointly defining a combustion chamber and the engine further includes a crank shaft connected to the piston and a crankcase wherein pressure is developed in response to the movement of the piston. The arrangement comprises: an injection nozzle opening into the combustion chamber; a fuel injection pump including: a housing defining an enclosed space; a diaphragm partitioning the enclosed space into a pulse chamber and a return chamber; and, pumping means operatively connected to the diaphragm for pumping fuel to the combustion chamber via the injection nozzle; opening means provided on the engine for communicating with the crankcase; a line connecting the opening means to the pulse chamber so as to permit the pressure in the crankcase to act upon the diaphragm; and, control means operatively connected to the crank shaft for clearing and blocking the opening means as a predetermined function of the movement of the piston in the cylinder of the engine so as to delay the onset of the injection of fuel into the combustion chamber after each combustion therein.

In the fuel arrangement according to the invention, no additional movable components are required since a movable part of the two-stroke engine is utilized as a closure member for a control opening. Because of the simple configuration, the control of the control opening is most robust and substantially free of maintenance so that a utilization even in work tools subjected to intense loads such as motor-driven chain saws is possible without malfunctions occurring. The initiation of the fuel injection operation is assured at precisely the same angular position of the crank shaft for each revolution and thereby the same piston position because of the specific position of the control opening in relationship to the movable parts of the two-stroke engine. In this way, it is assured that an injection will always only occur after opening of the overflow channel whereby a purging with pure air is always present.

It is advantageous to provide the crank web of the two-stroke engine as the movable part and to provide the control opening in the housing of the crankcase. All that is required is that the crank web be machined to provide an adequately narrow sealing gap between the crank web and the housing wall containing the control opening. The position of the control opening referred to the crank angle and the extent or length of the crank web in the peripheral direction determine the region of the crank angle in which the control opening is closed. This crank angle region is so positioned that the injection of fuel is prevented with certainty especially in the critical ranges during a cycle.

According to a preferred embodiment of the invention, the control opening is arranged in the cylinder of the two-stroke engine so that it lies in the stroke-range of the piston, with the piston clearing the control opening in predetermined regions of the piston stroke. With this embodiment, the sealing gap which is already present between the cylinder and the piston of a two-stroke engine is advantageously utilized. There are no machining operations required for producing the sealing gap.

According to another feature of the invention, a connecting opening to the crankcase is advantageously provided in the piston casing which communicates with the control opening in predeterminable regions of the stroke of the piston. In this way, the crank angle range can be determined independently of the stroke position in which the connecting opening is to communicate with the control opening. More specifically, the crank angle range during which the injection operation is to occur can be determined.

In addition to this connecting opening, the control opening is advantageously controlled by the lower edge of the piston jacket. This control is especially desirable for relieving pressure in the pulse chamber in response to a negative crankcase pressure in the region of upper dead center of the piston.

A relief of pressure in the pulse chamber from the pressure present in the crankcase at top dead center is achievable without additional control means with the aid of a check valve. The check valve is a bypass to the closed control opening and connects the latter directly to the crankcase. The check valve opens in the direction of the crankcase so that with a pressure drop from the pulse chamber to the crankcase, the check valve opens and allows a pressure equalization to occur.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
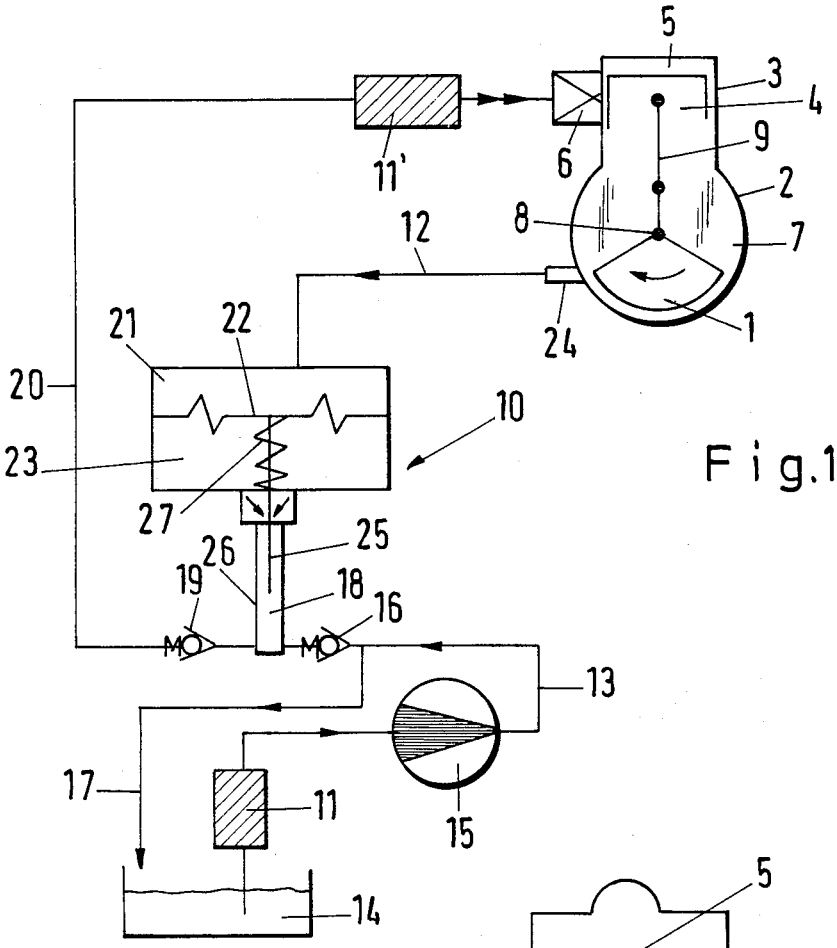
FIG. 1 is a schematic of the fuel injection arrangement according to the invention with the two-stroke engine being shown in section and including a crank web control for driving the injection pump.

The injection arrangement according to the invention is provided for a two-stroke engine 2 which is used in particular in handheld portable tools such as motor-driven saws and the like. The engine 2 has a cylinder 3, a piston 4, a combustion chamber 5, an injection nozzle 6, a crankcase 7 as well as a crank shaft 8 having a crank web 1 and a connecting rod 9 for the piston 4. During operation of the two-stroke engine, the pressure in the crankcase 7 changes with the upward and downward movement of the piston 4. The pressure increases with the downward movement of the piston 4 from top dead center to approximately bottom dead center so that an overpressure develops in the crankcase which drops again to an underpressure with the upward movement of the piston 4 (see also FIGS. 3 and 6).

The injection arrangement shown in FIG. 1 includes an injection pump 10 having a connecting line 12 which is connected to a control opening 24 directly on the crankcase 7 and conducts the pressure present in the crankcase directly to the injection pump 10. A more detailed view of an injection pump of the kind shown schematically in FIG. 1 is provided in the above-mentioned U.S. Pat. No. 4,700,668 referred to above.

In addition, a fuel feed line 13 is connected to the injection pump 2 through which the fuel is pumped from the tank 14 via a fuel filter 11 by means of a feed pump 15 to an intake valve 16 configured as a check valve. The feed pressure is so adjusted that the intake valve 16 does not open. Fuel which is not drawn in is returned via return line 17 to the tank 14.

The intake valve 16 is located on one side of a pump chamber 18 built into the housing 17 of the fuel injection pump 10; whereas, an outlet valve 19 is mounted on the opposite side and is likewise configured as a check valve. A fuel injection line 20 runs from this outlet valve 19 via a further fuel filter 11' to the fuel injection nozzle 6 of the two-stroke engine 2.

The connecting line 12 leading away from the crankcase 7 leads to a pulse chamber 21 of the fuel injection pump 10. The pulse chamber 21 is separated from an adjacent return chamber 23 by means of a membrane 22. The pulse chamber 21 and the return chamber 23 conjointly define the drive chamber of the fuel injection pump. The return chamber 23 is advantageously chargeable with a controlled pressure. It is sufficient to configure the return chamber 23 to have an open connection to the atmosphere.

A pump piston 25 is attached at the center of the membrane 22 and is guided in a pump cylinder 26 and limits therewith the pump chamber 18. The membrane 22 is biased in its upper starting position by means of a return spring 27. The membrane plate is configured to have appropriate cutouts in order to reduce weight and keep down the mass to be moved. In this way, the membrane plate can follow rapid changes in pressure without difficulty.

As shown in the section view of the two-stroke engine in FIG. 1, the control opening 24 is just closed by the crank web 1 approximately in the top dead center position of the piston 4. For this purpose, the crank web 1 is machined and a narrow sealing gap is provided between the crank web and the wall of the crankcase 7. The crank web extends over 120° of the crank shaft 8 in the peripheral direction of the crank shaft so that the control opening is again opened after a 120° rotation and the pressure present in the crankcase can act in the pulse chamber 21 via the connecting line 12.

Figure 2:
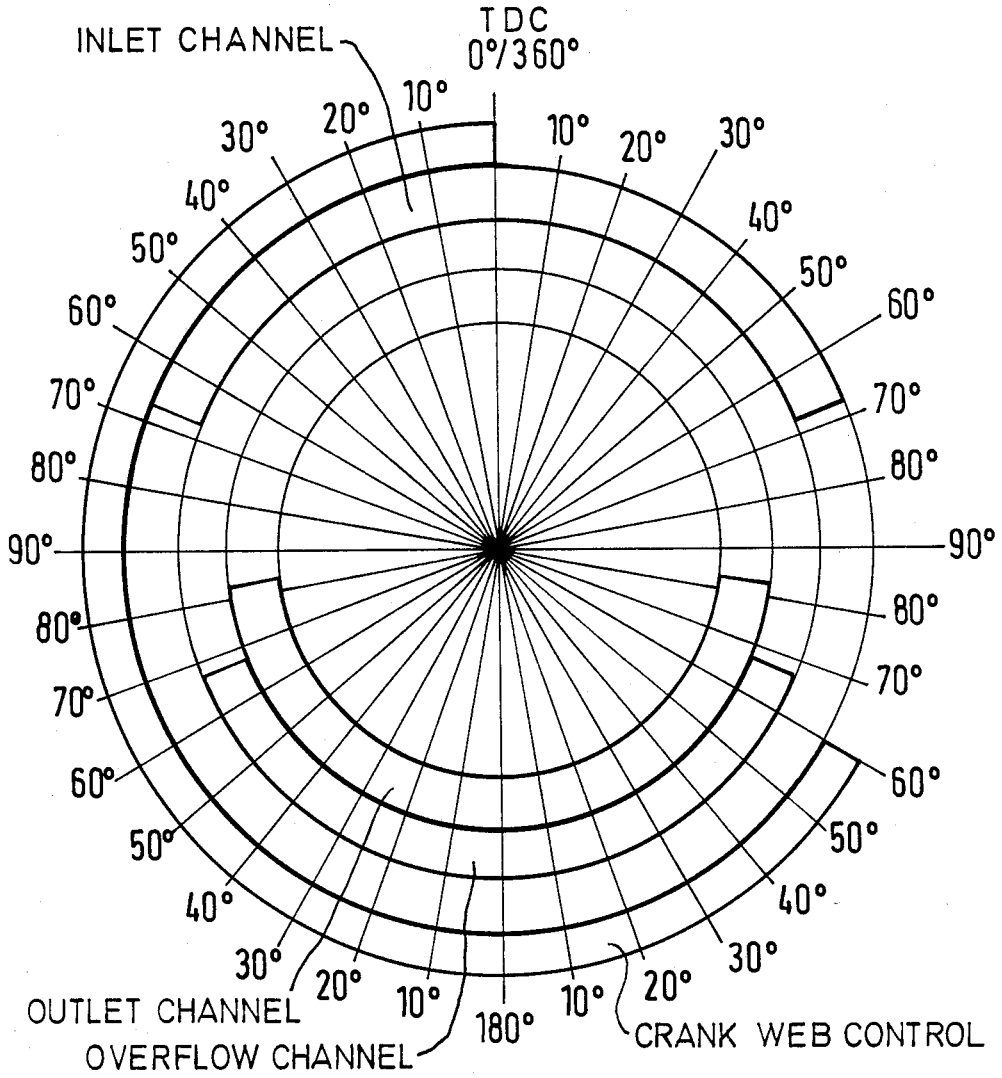
FIG. 2 is a circle control diagram for the two-stroke engine shown in FIG. 1.

The control diagram of FIG. 2 graphically shows the coaction of the control of the inlet channel, the outlet channel and the overflow channel in the two-stroke engine 2. Each of the opening times of the channels are shown over 360°. The opening of the control opening 24 is also shown in this control diagram. The control opening is opened at approximately 120° after top dead center and is again closed at 0° because of the constructive configuration and arrangement of the control opening 24 and the crank web 1.

Figure 3:
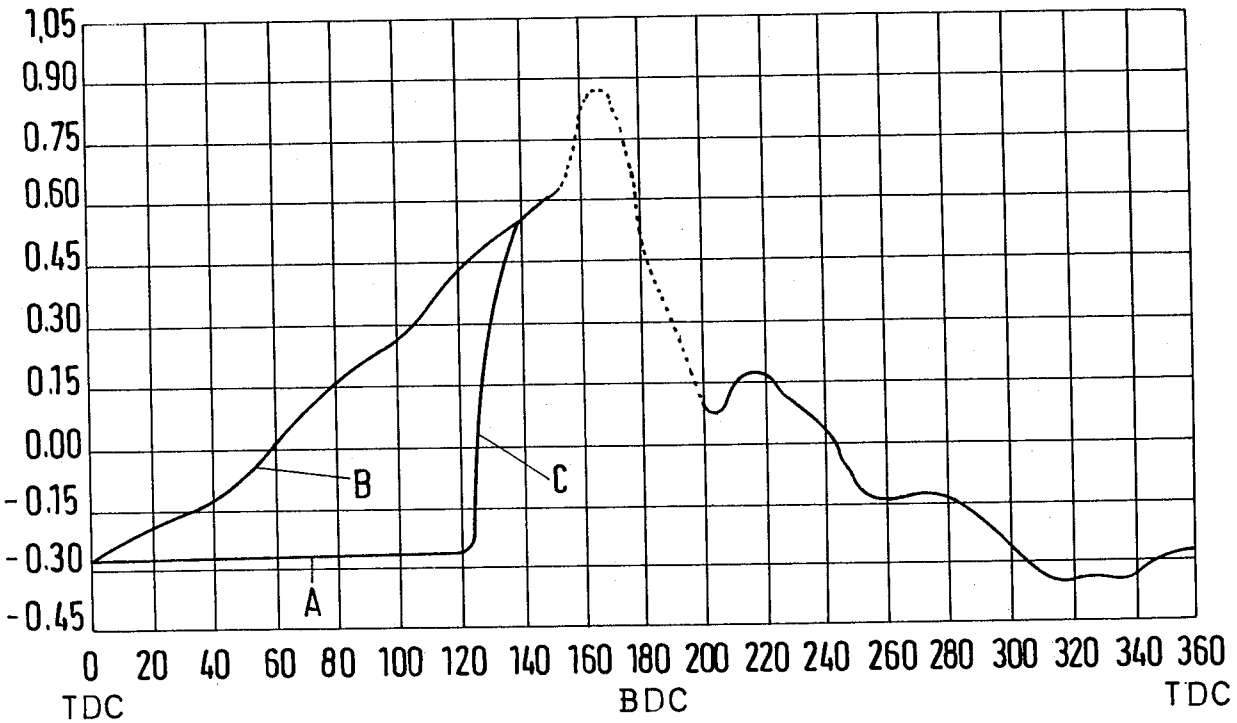
FIG. 3 is a diagram showing the course of pressure (bar) in the crankcase of the two-stroke engine as a function of the angular position of the crank shaft after top dead center.

The course of the pressure in the pulse chamber 21 can be read off the graph of FIG. 3 showing the course of the pressure in the crankcase 7 as a function of the crank angle. From top dead center to 120°, the crank web 1 closes off the control opening 24 so that the pressure in the pulse chamber (branch A of the curve of FIG. 3) remains unchanged; whereas, the crankcase pressure increases (branch B of the curve of FIG. 3). When the control opening 24 is opened at approximately 120° after top dead center (TDC), the pressure in the pulse chamber increases sharply to the pressure present in the crankcase (branch C of the curve of FIG. 3) and then changes over 240° in correspondence to the pressure changes in the crankcase since the control opening 24 is not closed off by the crank web 1 over this crank angle range. The control opening 24 is again closed by the crank web 1 at top dead center so that the pressure in the pulse chamber 21 remains constant until the control opening 24 is again opened. The pressure in the pulse chamber 21 drops to the underpressure in the crankcase present at top dead center at the time of closure of the control opening 24.

The initiation of the injection operation always occurs only after the control opening 24 is cleared by the crank web 1. The high crankcase pressure then applied to the pulse chamber 21 presses the membrane 22 downwardly against the force of the spring 27 whereby the pump piston 25 plunges into the pump chamber 18 of the pump cylinder 26 and presses the fuel through the outlet valve 19, the injection line 20 and through the injection nozzle 6 into the combustion chamber 5. The actual injection operation during which the fuel is transported from the injection nozzle 6 into the combustion chamber 5 occurs approximately at bottom dead center of the cylinder 4. The pressure in the crankcase 7 reduces with the following upward movement of the piston from bottom dead center toward top dead center. When the crossover of the crankcase pressure "zero" occurs approximately after 240°, an underpressure develops in the crankcase 7 which causes the membrane 22 to pull back the pump piston 25. An underpressure develops in the pump chamber 18 with the return movement of the pump piston 25 so that the inlet valve 16 opens and fuel flows into the pump chamber 18. The inflow via suction of the fuel occurs during the underpressure phase in the crankcase 7; whereas, the initiation of the injection process and the injection itself occur with increasing crankcase pressure.

With the crank web control according to the invention, a constructive arrangement is provided which ensures that the injection always occurs after the completed combustion of the previous cycle and after the occurrence of the opening of the outlet channel and especially of the overflow channel. With the opening of the overflow channel in advance of the injection, an air supply is obtained which ensures a good mixture formation.

Figure 4:
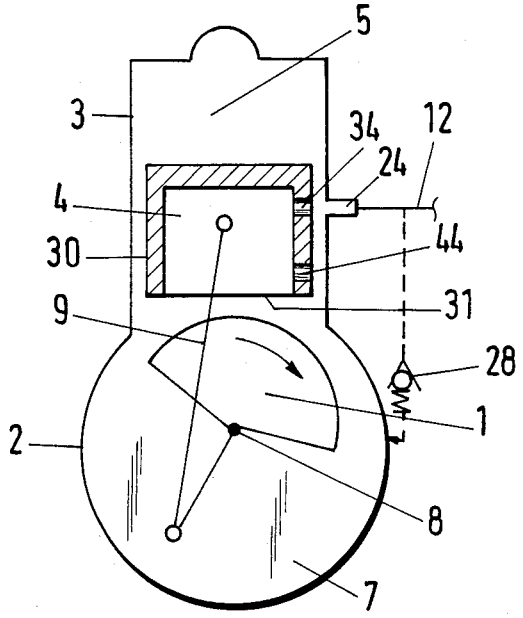
FIG. 4 is a schematic section view through the two-stroke engine equipped with a piston jacket control for driving the injection pump.

A preferred embodiment of the invention is shown in FIG. 4. The control opening 24 is provided here at the cylinder 3 in the stroke region of the piston 4 and no longer at the crankcase 7. A connecting opening 34 in the piston jacket 30 is provided for the control opening 24. The connecting opening 34 is disposed beneath the piston sealing rings such that the control opening 24 communicates with the connecting opening 34 starting at approximately 120° after top dead center (60° ahead of bottom dead center). Since the connecting opening 34 opens into the inner hollow space of the piston 4 and since the piston 4 is open toward the crankcase chamber, the crankcase pressure is present at the control opening 24 starting at approximately 120° and is provided via connecting line 12 to the pulse chamber 21 to actuate the injection pump.

Figure 5:
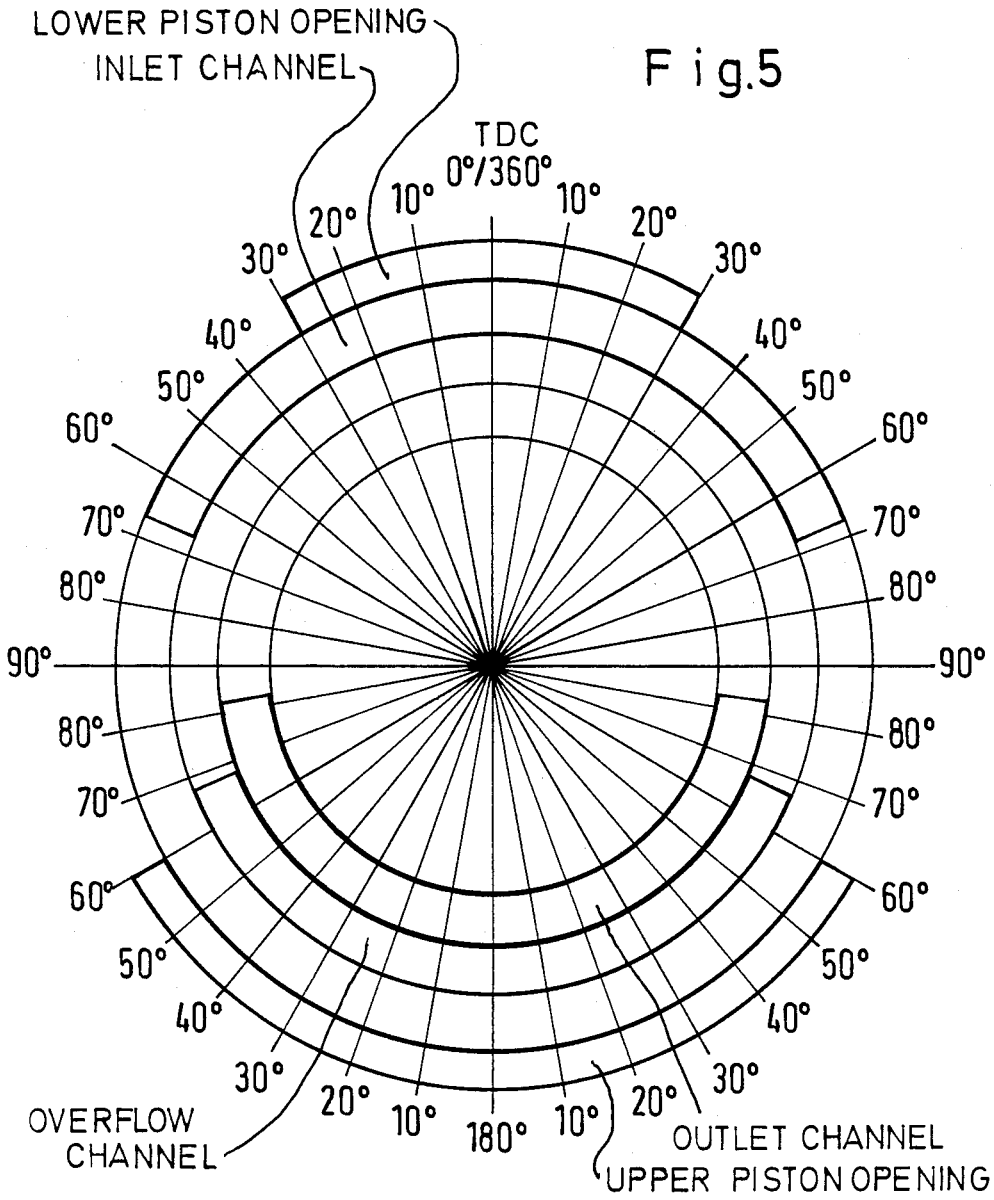
FIG. 5 is a control diagram of the two-stroke engine of FIG. 4.

The control diagram of FIG. 5 shows the symmetrical movement of the piston about the reversal point of bottom dead center. Because of this symmetrical movement of the piston, the control opening 24 is again closed by the piston jacket 30 at 60° after bottom dead center (240° after top dead center).

Figure 6:
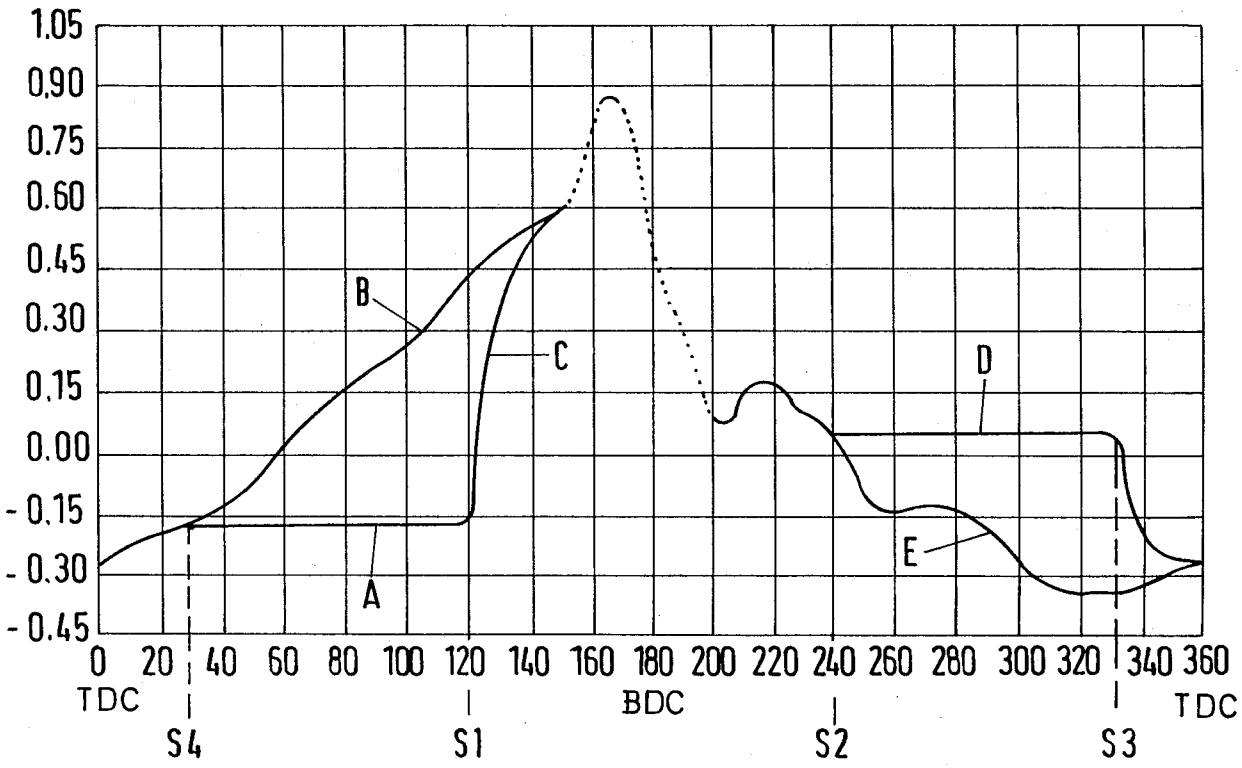
FIG. 6 is a diagram showing the course of pressure (bar) in the crankcase of the two-stroke engine as a function of he angular position of the crank shaft after top dead center.

As shown in the course of the pressure of FIG. 6, a positive crankcase pressure is still present at the crank shaft position S2 (240°) which is stored in pulse chamber 21 because the control opening is closed starting at 240°. In this way, a complete return movement of the pump piston 25 of the injection pump into its starting position is prevented whereby the quantity of fuel drawn in by suction is reduced. In order to prevent this, a relief opening 44 arranged beneath the connecting opening 34 is provided in the pulse jacket 30 to provide a complete pressure relief of the pulse chamber 21. The relief opening 44 communicates with the control opening 24 at the top dead center of the piston 4 at which the crankcase pressure is negative (underpressure). Preferably, the relief opening 44 is provided such that it communicates with the control opening 24 starting at approximately 30° ahead of top dead center up to 30° after top dead center. The relief opening 44 can also be configured as a slit in the piston jacket opening toward the crankcase or generally be configured by shortening the piston jacket.

The control diagram of FIG. 6 shows the opening times of the individual channels of the two-stroke engine as well as the opening times of the openings in the piston jacket as a function of the crank angle. Here, too, it is important that the injection is always initiated at the same crank angle by means of the constructively determined position of the control opening and the connecting opening. In this way, it is assured that an injection always occurs after a completed combustion and after opening of the overflow channel.

The course of the pressure in the pulse chamber 21 is then provided from the course of the pressure in the crankcase pursuant to FIG. 6. The control opening is opened at the crank shaft position S1 (120° after top dead center). The pressure in the pulse chamber 21 increases sharply to the crankcase pressure (branch C) and follows this curve up to the crank shaft position S2 (240° after top dead center). The pressure in the pulse chamber 21 remains constant (branch D) because of the closed control opening 24 while the crankcase pressure drops to negative pressure values (branch E).

In order to assure a return of the pump piston 25 of the injection pump 10 and therewith an intake of an adequate quantity of fuel, the control opening 24 is opened in the crank shaft position S3 (30° ahead of top dead center) by the relief opening 44 so that a pressure equalization takes place between the crankcase 7 and the pulse chamber 21. Symmetrically with top dead center, the control opening again closes at 30° after top dead center so that the pressure value in the pulse chamber 21 again remains unchanged (branch A) while the crankcase pressure increases (branch B). The connecting opening 34 again opens the control opening 24 in the crank shaft position Sl and the cycle begins anew as described.

In lieu of the relief opening 44 in the piston jacket, the latter can be so configured that its lower jacket edge 31 serves as the control edge for the control opening 24 at top dead center and assures a complete pressure equalization in the pulse chamber 21 in the manner described by means of the opening of control opening 24.

It can be advantageous to configure the connecting opening 34 and the relief opening 44 as slots having longitudinal axes aligned so as to be transverse to the longitudinal direction of the piston 4.

A further embodiment of the invention is shown in FIG. 4 wherein a check valve 28 opening toward the crankcase 7 is provided between the crankcase 7 and the pulse chamber 21. The connection of the check valve 28 is shown by dashed lines in FIG. 4. It is preferable to build the check valve directly on or in the two-stroke engine. The check valve 28 directly connects the control opening 24 with the crankcase 7. With the control opening 24 closed, the check valve 28 blocks a pressure equalization from the crankcase to the pulse chamber. If the control opening 24 to the crankcase 7 is open, then the same pressure is present at both sides of the check valve 28 and the latter remains closed because of its return force.

If the control opening 24 is again closed and if the pressure in the crankcase 7 drops further, then a pressure equalization from the pulse chamber 21 occurs in the direction toward the crankcase. The pressure in the pulse chamber 21 runs in branch E of the pressure course shown in FIG. 6 also after closure of the control valve 24 in the crank shaft position S2. The lowest pressure occurring in the crankcase adjusts itself in the pulse chamber 21. The sharp pressure increase (branch C) starts from this pressure value at the crank shaft position Sl when the control opening 24 is opened to the crankcase pressure which in the meantime has increased.

It is understood that the foregoing description is that of the preferred embodiments of the invention and that various changes and modifications may be made thereto without departing from the spirit and scope of the invention as defined in the appended claims.

What is claimed is:

1. An arrangement for injecting fuel in a two-stroke engine for handheld portable tools such as motor-driven chain saws, the engine having a piston and a cylinder conjointly defining a combustion chamber, the engine further including a crank shaft connected to the piston and a crankcase wherein pressure is developed in response to the movement of the piston, the arrangement comprising:

an injection nozzle opening into the combustion chamber;

a fuel injection pump including: a housing defining an enclosed space; a diaphragm partitioning said enclosed space into a pulse chamber and a return chamber; and, pumping means operatively connected to said diaphragm for pumping fuel to said combustion chamber via said injection nozzle;

opening means provided on the engine for communicating with the crankcase;

a line connecting said opening means to said pulse chamber so as to permit the pressure in the crankcase to act upon said diaphragm; and, control means operatively connected to the crank shaft for clearing and blocking said opening means as a predetermined function of the movement of the piston in the cylinder of the engine so as to delay the onset of the injection of fuel into the combustion chamber after each combustion therein.

2. The arrangement of claim 1, said opening means being disposed in the crankcase; and, said control means being a movable part in the form of a crank web attached to the crank shaft.

3. The arrangement of claim 2, wherein the piston moves from top dead center to bottom dead center in said cylinder; and, said crank web being mounted on said crank shaft so as to cause said opening means to be closed in the range between top dead center to approximately 120° after said top dead center.

4. The arrangement of claim 1, said opening means being disposed in the cylinder in the range of the stroke of the piston; and said piston including said control means for clearing said opening means in a predetermined portion of the stroke of the piston.

5. The arrangement of claim 4, wherein the piston includes a piston jacket and said control means includes a connecting opening formed therein for communicating with the crankcase; said connecting opening being located in said piston jacket for communicating with said opening means in said predetermined portions of said stroke.

6. The arrangement of claim 5, said connecting opening being disposed in said jacket so as to communicate with said opening means over a crank shaft angular range of approximately 120° after TDC to approximately 240° after TDC (60° after BDC).

7. The arrangement of claim 4, the piston defining a piston jacket having a lower edge facing toward the crankcase; and, said control means being then said lower edge.

8. The arrangement of claim 5, said piston jacket including a relief opening disposed beneath said connecting opening for communicating with said opening means during a crank shaft angular range of approximately 30° ahead of TDC to approximately 30° after TDC.

9. The arrangement of claim 8, said connecting opening and said relief opening conjointly defining a slot.

10. The arrangement of claim 4, comprising a check valve interconnecting said pulse chamber and the crankcase; and, said check valve being disposed so as to open toward the crankcase.

11. The arrangement of claim 10, said check valve having respective ends and being mounted on the engine so as to cause one of said ends to communicate with said opening means and the other one of said ends to communicate with the interior of the crankcase.

* * * * *

UNITED STATES PATENT AND TRADEMARK OFFICE

CERTIFICATE OF CORRECTION

PATENT NO. : 4,813,391

DATED : March 21, 1989

INVENTOR(S) : Werner Geyer, Roland Schierling and Hans Nickel

It is certified that error appears in the above-identified patent and that said Letters Patent is hereby corrected as shown below:

On the cover page, next to "Filed:": delete "Aug. 15, 1999" and substitute -- Aug. 15, 1988 -- therefor.

Signed and Sealed this

Twenty-sixth Day of September, 1989

*Attest:*

DONALD J. QUIGG

*Attesting Officer*

*Commissioner of Patents and Trademarks*